United States Patent [19]

Vaughan

[11] Patent Number: 4,564,347

[45] Date of Patent: Jan. 14, 1986

[54] CONTINUOUS EXTRUSION APPARATUS

[75] Inventor: Anthony J. Vaughan, Challock, Near Ashford, England

[73] Assignee: Babcock Wire Equipment Limited, Ashford, England

[21] Appl. No.: 599,328

[22] Filed: Apr. 12, 1984

[30] Foreign Application Priority Data

Apr. 12, 1983 [GB] United Kingdom ..... 8309875

[51] Int. Cl.[4] ..... B21C 23/30; B21C 29/00

[52] U.S. Cl. ..... 425/79; 29/33 D; 29/517; 72/256; 72/268; 425/113; 425/374; 425/376 B

[58] Field of Search ..... 72/262, 10, 13, 47, 72/256, 264, 268; 425/79, 224, 374, 114, DIG. 806 R, 376 A, 376 B, 294, 311, 113; 264/176 C, 161, 163; 29/33 D, 517, 520

[56] References Cited

U.S. PATENT DOCUMENTS

| | | | |
|---|---|---|---|
| 1,924,294 | 8/1933 | Shirk et al. | 72/264 |
| 3,073,441 | 1/1963 | Priaroggia et al. | 72/268 |
| 3,302,440 | 2/1967 | Seidel et al. | 72/268 |
| 3,336,783 | 8/1967 | Johnsen et al. | 72/268 |
| 4,277,968 | 7/1981 | Pardoe | 72/262 |

FOREIGN PATENT DOCUMENTS

| | | | |
|---|---|---|---|
| 0139222 | 10/1981 | Japan | 72/262 |
| 2081153 | 2/1982 | United Kingdom | 72/262 |

*Primary Examiner*—Jay H. Woo
*Assistant Examiner*—James C. Housel
*Attorney, Agent, or Firm*—Kemon & Estabrook

[57] ABSTRACT

Apparatus for the continuous extrusion of metals in which feed is introduced into a pair of circumferential grooves in a rotating wheel to contact arcuate tooling and abutments. The feed is constrained by the abutments to flow through exit apertures in a die top from the respective grooves to a substantially toroidal chamber around a hollow, open ended, portal mandrel to extrude through an annular die orifice as a cladding for a continuous core. Cooling air may be supplied to the interior of the cladding, which is subsequently swaged down on to the core. A solid mandrel may be utilized where it is desired to extrude tube.

1 Claim, 7 Drawing Figures

CONTINUOUS EXTRUSION APPARATUS

This invention relates to apparatus for the forming of metals by a continuous extrusion process in which feedstock is introduced into a circumferential groove in a rotating wheel to pass into a passageway formed between the groove and arcuate tooling extending into the groove. The tooling includes an orifice extending in a generally radial direction from the groove to a die and an abutment is provided to constrain the feedstock to flow through the orifice and the die.

In UK Patent Specification No. 1 566 152 there is described continuous extrusion apparatus having a rotatable wheel formed with two identical circumferential grooves, arcuate tooling with portions bounding radially outer portions of the respective grooves provided with exit apertures extending in a generally radial direction from the respective grooves to a single chamber of generally parallelepiped form and one or more die orifices supplied from the single chamber.

The die orifices are positioned in wall portions of the single chamber of generally parallelepiped form and discharge either through an outer wall in a direction generally radially of the wheel or through side walls in a direction generally parallel to the wheel axis. With such a configuration with the dies positioned in the walls, it is necessary to utilise bridge dies, that is die mandrels supported on bridge webs located on the wall, to produce tubular extrusions. The presence of the bridge webs gives rise to weld lines in the extrusion, which, on occasion, it is desirable to avoid.

In a continuous extrusion apparatus according to the present invention the exit apertures extend through a die top from the respective grooves to a substantially toroidal chamber around a portal mandrel discharging axially of the mandrel through a die orifice of uninterrupted annular cross-section intermediate the mandrel and a die body wall.

The invention will now be described, by way of example, with reference to the accompanying, partly diagrammatic, drawings, in which.

Figure 1:
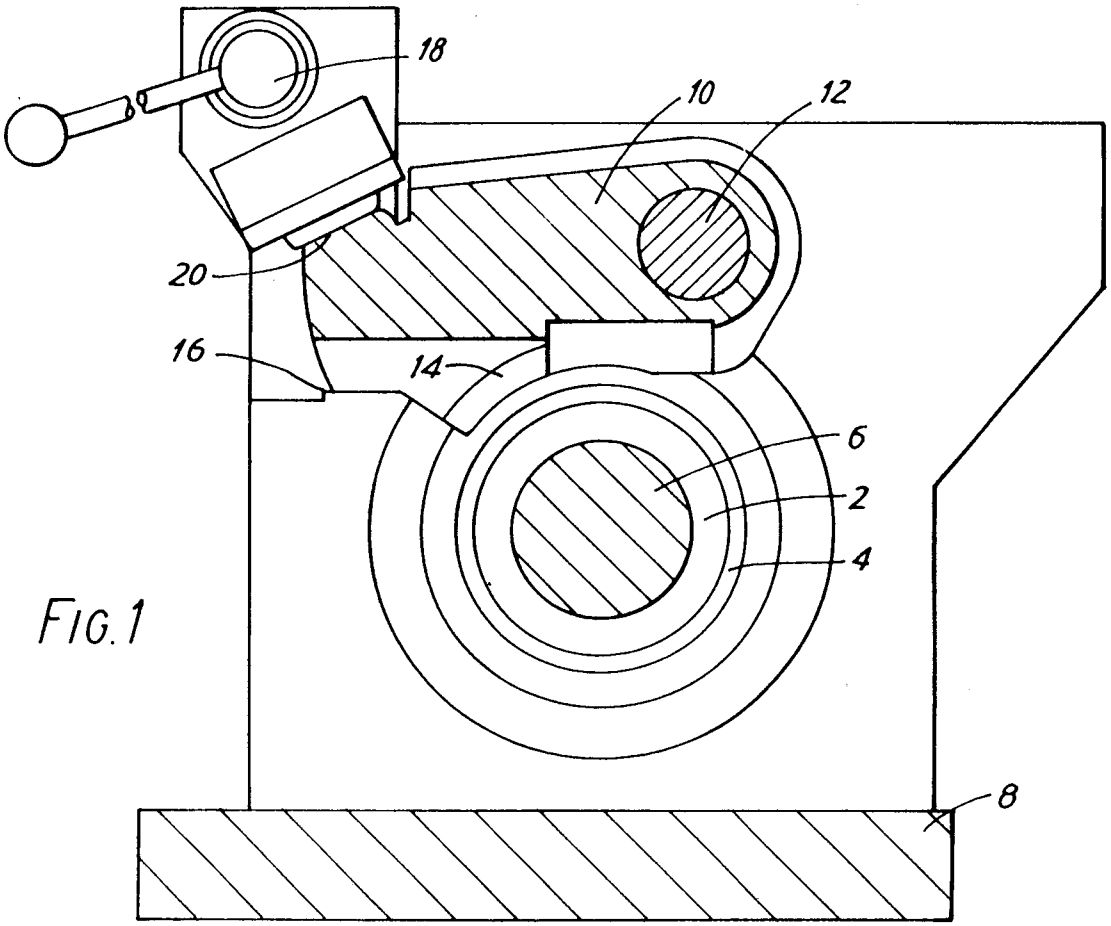
FIG. 1 is a cross-sectional elevation of continuous extrusion apparatus omitting details of a die portion.

As shown in FIG. 1, the continuous extrusion apparatus includes a wheel 2 provided with a pair of circumferential grooves 4 and is mounted on a horizontal drive shaft 6 running in bearings positioned on a bed 8. A shoe 10 mounted on a pivot 12 extending parallel to the horizontal drive shaft 6 carries two sets of arcuate tooling 14 registering with the respective grooves 4 and is urged against a stop 16 positioned adjacent the wheel 2 and above the drive shaft 6 by means of a cam lever 18 bearing against a shoulder 20 formed on the shoe. Each set of tooling 14 includes a shoe insert 22 (FIG. 2) forming a closure to the adjacent portion of the groove 4 and an abutment 24 extending into the groove to form an obturation with a single die top 28 spanning the two grooves.

Figure 2:
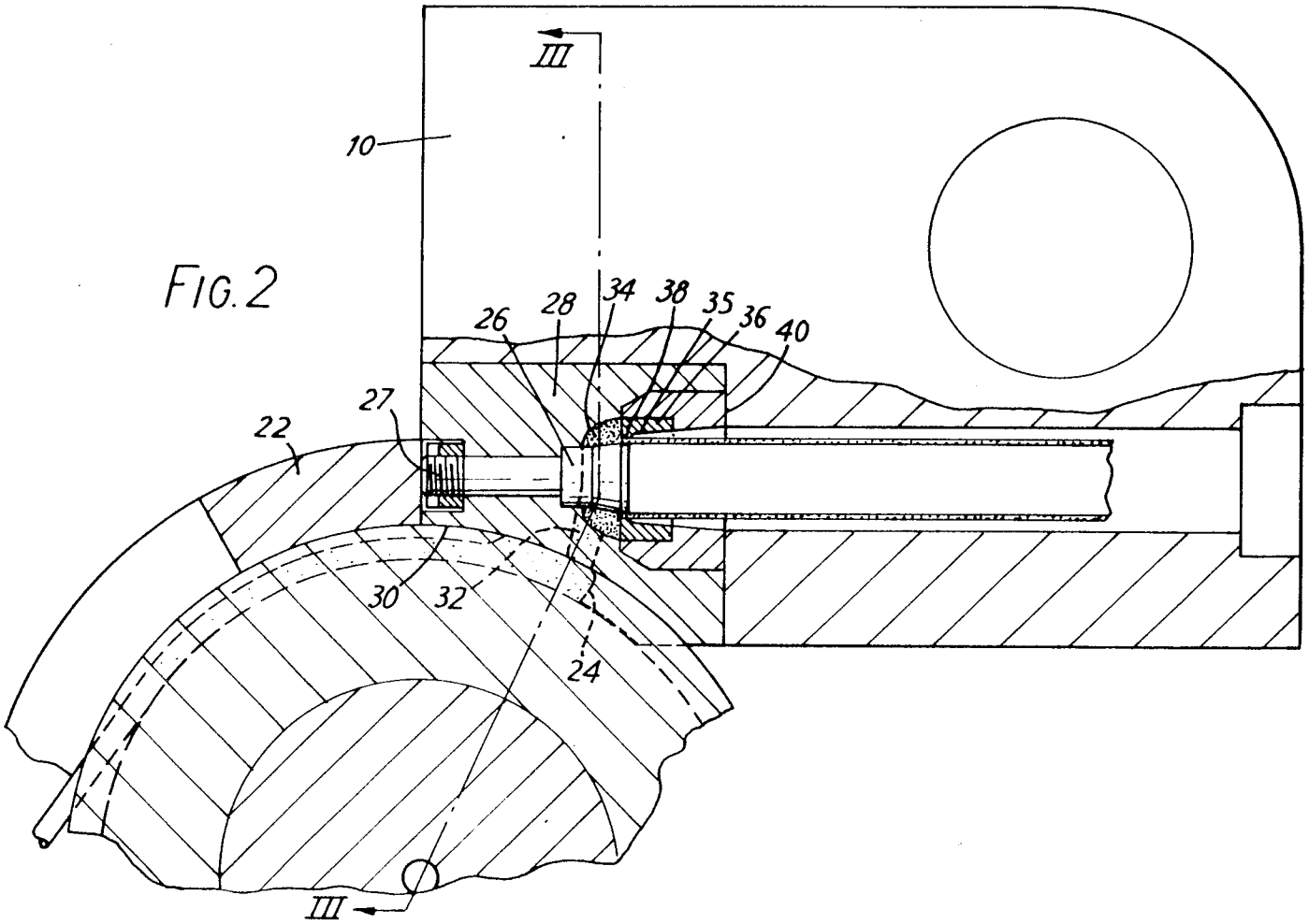
FIG. 2 is a cross-sectional elevation of a die portion adapted to produce tube.
Figure 3:
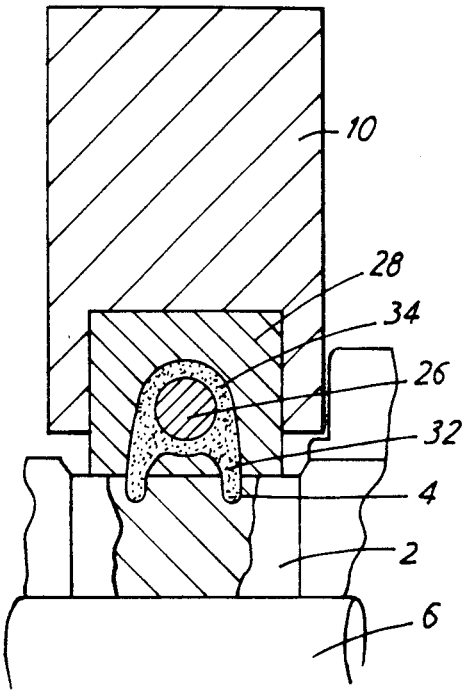
FIG. 3 is a cross-section taken on the line III—III of FIG. 2.

As shown in FIGS. 2 and 3, the die top 28 includes a pair of convex surfaces 30 registering with the respective grooves and each penetrated by an exit aperture 32 leading to a central, toroidal, extrusion chamber 34 disposed symmetrically of a radial plane intermediate the grooves. A portal mandrel 26 is positioned by means of a stub 27 in the die top 28 and extends horizontally and parallel to a line tangential to the wheel 2 co-axially through the extrusion chamber 34 and a die body wall 35 to form an uninterrupted extrusion orifice 38 discharging through the face 40 of the die top.

In operation, to produce a tubular extrusion, a mandrel and die body appropriate to the required tubular extrusion cross-section are positioned in the die top 28, the shoe 10 pivoted into contact with the wheel 2 and the cam lever 18 positioned to apply force to the shoe. The drive is then energised and feedstock introduced into the grooves to flow through the respective apertures 32 and into the extrusion chamber 34. The flows from the respective apertures combine in the extrusion chamber and are extruded through the annular extrusion orifice 38 to produce a continuous tubular product.

Since the path for the product from the grooves 4 to the extrusion orifice 38 is relatively short and free from discontinuities, the product flows smoothly from the grooves to the extrusion orifices with a minimum of dissipation of energy. Accordingly the power consumption of the process is restricted and discontinuities in the extruded product are avoided or reduced to a minimum.

Figure 5:
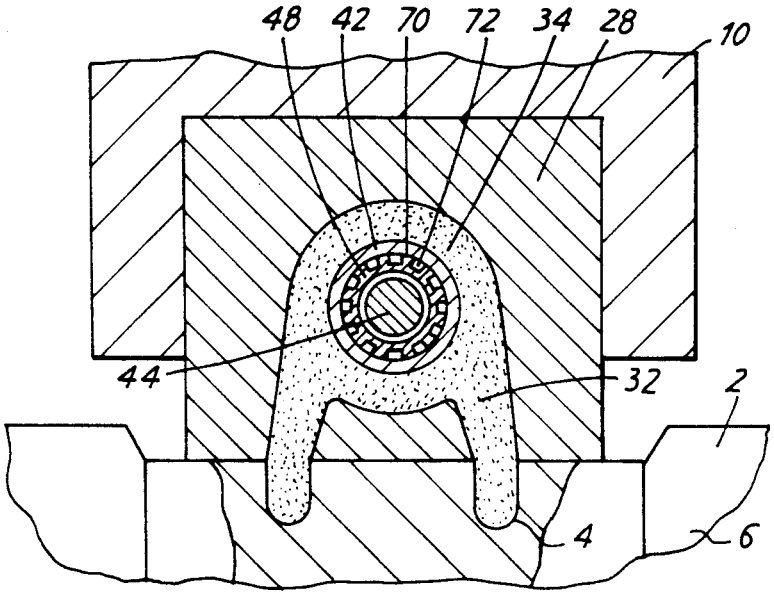
FIG. 5 is a cross-section taken on the line V–V of FIG. 4.
Figure 4:
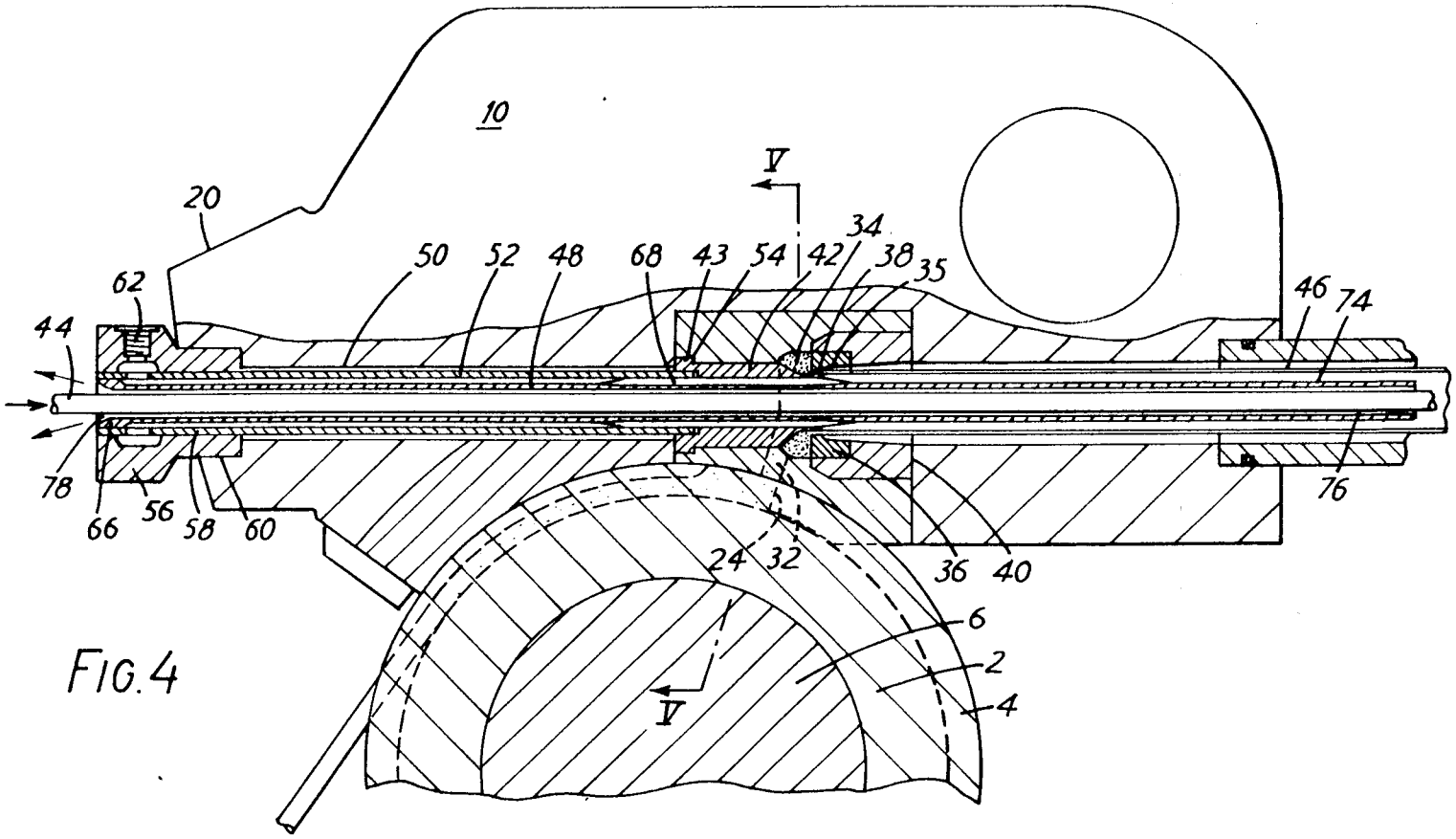
FIG. 4 is a cross-sectional elevation of an alternative die portion adapted to form a tubular cladding on a continuous core.

In the arrangement indicated in conjunction with FIGS. 4 and 5, a hollow, open-ended mandrel 42 is positioned with a stepped rear end portion 43 co-acting with correspondingly stepped bores 54 in the die top 28. A core 44 to be clad is fed, in the same direction as the direction of feed of the feedstock, through the hollow mandrel 42 emerging at the annular extrusion orifice 38 to receive a cladding of the extruded product 46. In the arrangement shown the core has a plastics material as an outer layer, which is sensitive to elevated temperatures. Accordingly the mandrel is provided with an internal cooling shroud 48 to protect the core from the product which immediately after extrusion is at a temperature of about 450° C. The product 46 is extruded with an internal diameter greater than the external diameter of the core 44, to permit the intervention of a portion the cooling shroud 48 and is subjected to a stream of cooling air, flowing initially intermediate the product and the shroud and then to exhaust. To this end a passage 50 is drilled in the shoe 10 to extend co-axially of the hollow, open ended, mandrel 42. An outer sleeve 52 having the same internal diameter as that of the mandrel 42 is passed through the passage 50 and threaded into the rear end portion 43 of the mandrel. A spigot 56 is secured to the rear end 58 of the outer sleeve to seat in a counter-bore 60 in the shoe 10 and is provided with a cooling air inlet tapping 62 extending through the outer sleeve 52. The tubular shroud 48 is positioned internally co-axially of, and radially spaced from, the outer sleeve 52 and is sealed to a rear end portion 66 of the outer sleeve outward of the cooling air inlet tapping. An intermediate portion 68 of the shroud adjacent the mandrel is of increased wall thickness with axial lands 70 and grooves 72 formed in the thickened portion, the lands 70 seating on the interior of the mandrel 42 to support the shroud and the grooves 72 permitting the flow of cooling air. A forward portion 74 of the shroud extends beyond the annular die orifice 38 by an amount to provide a path of sufficient length to ensure the requisite transfer of heat from the extruded product to the cooling air. The cooling air exhausts to atmosphere through a space 76 intermediate the interior of the shroud and the core feed and through an internally chamfered wall rear end portion 78 of the shroud. Swaging means (not shown) are provided to effect swaging down of the extruded cladding product 46 on to the core 44 beyond the forward portion 74 of the shroud.

Figure 6:
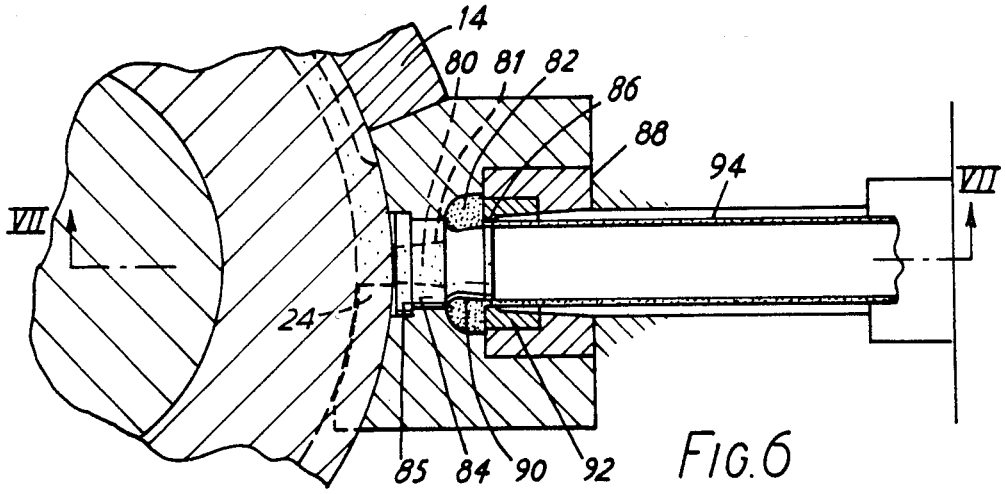
FIG. 6 is a cross-sectional elevation of an alternative arrangement of a die portion adapted to produce tube.
Figure 7:
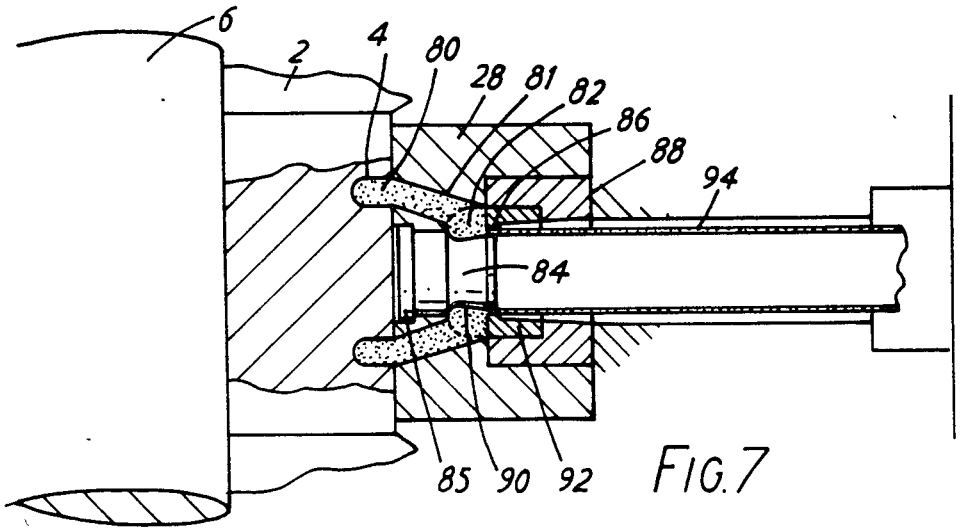
FIG. 7 is a cross-section taken on the line VII–VII of FIG. 6.

In a further alternative arrangement indicated in FIGS. 6 and 7, where it is not required to feed a core to the interior of a tubular extrusion 94, extrusion is effected along a horizontal axis passing through the wheel axis, that is, along a radial axis. Thus the shoe 10 carries two sets of tooling 14 with the abutment 24 of each positioned slightly below the horizontal central plane passing through the wheel axis. Exit apertures 80 from convex surfaces of the die top 28 registering with the grooves 4 extend horizontally with diverging passageways 81 toward a central, toroidal, extrusion chamber 82. A portal mandrel 84 positioned by means of a stepped stub portion 85 in the die top extends horizontally adjacent the wheel along an axis radial to the wheel co-axially of the extrusion chamber and a die body wall adjacent the extrusion chamber to form an uninterrupted annular extrusion orifice 86 discharging through the face 88 of the die top remote from the wheel. The portal mandrel is formed with a circumferential, arcuate section, groove 90 defining a portion of the extrusion chamber wall.

In operation, to produce a tubular extrusion, as previously, the appropriate mandrel 84 and die body 92 are positioned in the die top 28, the shoe 10 positioned in contact with the wheel 2, the drive energised and feed established to the two grooves. The flows from the respective apertures 80 combine in the extrusion chamber 82 and are extruded through the annular extrusion orifice 86 to produce a continuous tubular product. It will be appreciated that the length of the diverging passageways 81 connecting the grooves 4 to the extrusion chamber 82 and extrusion orifice 86 is short and does not involve substantial discontinuities or changes in direction of flow of the product. Thus a minimum of energy is dissipated thereby minimising the power requirements and making for the production of tubular extrusions free from undesirable discontinuities.

It will be appreciated that, in each of the arrangements, passages may be provided in the die top and, in instances where an otherwise solid portal mandrel is utilised, in the mandrel, for the flow of cooling liquid to effect extraction of heat from the various components and avoid temperatures in the components exceeding desirable working limits.

I claim:

1. Continuous extrusion apparatus having a rotatable wheel formed with two identical circumferential grooves, arcuate tooling with portions bounding radially outer portions of the respective grooves provided with exit apertures extending in a generally radial direction from the respective grooves to a single chamber and abutments displaced in the direction of rotation from the apertures extending into the grooves, characterized in that the exit apertures extend through a die top from the respective grooves to a substantially toroidal chamber around a portal mandrel discharging a tubular extrusion product axially of the mandrel through a die orifice of uninterrupted annular cross-section intermediate the mandrel and a die body wall, a tubular shroud comprising a forward portion, an intermediate portion and a rear end portion, the intermediate portion having an increased wall thickness in relation to the wall thickness of both the forward portion and the rear end portion and being positioned internally co-axially of the mandrel and formed with alternating axially extending lands and grooves, the lands seating on the interior of the mandrel and the grooves providing a plurality of parallel cooling fluid flow passages, an outer sleeve extending co-axially externally of the rear end portion of the shroud and having an internal diameter equal the internal diameter of the mandrel secured to a rear end portion of the mandrel to form a first cylindrical passage intermediate the outer sleeve and the shroud, a spigot secured to the end of the outer sleeve by a fluid tight joint remote from the mandrel and seating in the arcuate tooling, the spigot being formed with a cooling fluid inlet tapping communicating with the said first cylindrical passage, the forward portion of the shroud extending internally co-axially of, and radially spaced from, a portion of the hollow portal mandrel adjacent and beyond the extrusion orifice and around a continuous core member supplied to the extrusion orifice respectively to form a second cylindrical passage intermediate the tubular extruded product and the forward portion of the shroud and a third cylindrical passage intermediate the forward portion of the shroud and the continuous core member, the said third cylindrical passage extending rearwardly intermediate the intermediate portion of the shroud and the continuous core member and intermediate the rear end portion of the shroud and the continuous core member to a cooling fluid exit at a rear face of the spigot, thereby forming a cooling fluid path extending from the cooling fluid inlet tapping through the first cylindrical passage, the grooves in the intermediate portion of the shroud, the second passage and the third passage to the cooling fluid exit, and swaging means positioned forwardly of the forward end of the shroud arranged to swage down the tubular extrusion product on to the continuous core member.

* * * * *